US005642620A

United States Patent [19]

Bakker

[11] Patent Number: 5,642,620

[45] Date of Patent: Jul. 1, 1997

[54] HOT GAS MOTOR AND COMPRESSOR UNIT

[76] Inventor: Albert Bakker, Vrijdomstreekje 3, 9503 AT Stadskanaal, Netherlands

[21] Appl. No.: 640,997

[22] Filed: Apr. 30, 1996

[51] Int. Cl.[6] ..... F01B 25/02

[52] U.S. Cl. ..... 60/682; 60/650; 418/196

[58] Field of Search ..... 60/650, 682; 418/10, 418/196

[56] References Cited

U.S. PATENT DOCUMENTS

| | | | |
|---|---|---|---|
| 3,889,471 | 6/1975 | Eskeli | 60/682 |
| 4,228,654 | 10/1980 | Hill | 60/682 |
| 4,357,800 | 11/1982 | Hecker | 60/682 |
| 4,663,939 | 5/1987 | Cosby | 60/682 |

*Primary Examiner*—Ira P. Lazarus

*Assistant Examiner*—Alfred Basichas

*Attorney, Agent, or Firm*—Evenson, McKeown, Edwards & Lenahan, P.L.L.C.

[57] ABSTRACT

The invention relates to a hot gas motor comprising a compressor with an inlet and an outlet, an expander with an inlet and an outlet. Herein the compressor outlet and the expander inlet are mutually connected by a connecting channel comprising a gas heating device. The compressor is of the rotation type with at least one male rotor mounted in a first cylindrical chamber in a housing and having a profile with protruding parts which engages in a female rotor which has a profile with recesses co-acting therewith and which is mounted in a second cylindrical chamber intersecting the first cylindrical chamber. The expander is herein formed by the female rotor and at least one male rotor having a profile with protruding parts co-acting therewith, and the rotors are mutually coupled for rotation.

10 Claims, 5 Drawing Sheets

HOT GAS MOTOR AND COMPRESSOR UNIT

The invention relates to a hot gas motor. Such a motor comprises a compressor and an expander. Gas compressed in the compressor is heated and fed to the expander. The compressor is coupled to the expander, whereby the compressor is driven with the expansion energy.

The invention has for its object to provide such a motor which can take a compact form and has a simple basic construction.

This object is achieved with the hot gas motor according to claim 1. In the simplest form only three moving parts are required, i.e. three rotors. The compressor type applied according to the invention can be embodied such that a high compression ratio is obtained, which results in a good efficiency of the motor.

The production costs of the motor according to the invention can remain comparatively low by applying the step of claim 2.

A very favourable further development is characterized in claim 3. A hot gas motor/compressor unit is hereby obtained which can function independently. The air partially expanded in the expander is stored as compressed air in the pressure reservoir. If the compressed air can be used immediately, i.e. without first cooling, a comparatively high efficiency can be achieved.

In the case the motor according to the invention must be used to drive a random device, the step of claim 4 is preferably applied. The gas herein circulates in a closed circuit so that a gas can be chosen that is suitable for the intended application, in particular a freon type. The gas cooling device results in a low pressure of the gas in the connecting channel between the expander outlet, which favours a high efficiency of the device.

According to a further development the step of claim 5 is applied. The compressor hereby acquires a very low dead volume, whereby a high pressure can be reached in one stage. This is particularly favourable in the application as motor compressor unit.

In preference the step of claim 6 is applied. A high pressure can be created in the connecting channel. The non-return valve prevents gas under high pressure flowing back to the compressor. Up to the point where the gas is sufficiently compressed in the compressor it is pressed into the connecting channel.

A favourable further development is characterized in claim 7. Leakage losses of the compressor and/or the expander are hereby greatly limited, which contributes to a good efficiency of the device. This efficiency can already be achieved at a relatively low power demand.

Use of the step of claim 8 results in a suitable form of the profiles of the rotors, which particularly enables a high compression with a low dead volume.

A suitable step is characterized in claim 9. The motor can be used at any random location where one fuel or another is available. It can thus be provided with a reservoir with its own fuel supply or be coupled to the gas main. The burner can of course be adapted to the type of fuel.

In preference the step of claim 10 is applied. As the load increases the rotation speed of the motor will tend to fall. In that case the heat production is increased by the control device whereby more power is supplied and the rotation speed remains substantially unchanged.

It is noted that the determination of the specific form of the rotors lies within the reach of a skilled person. In the European patent 0 211 826 is thus shown and described the principle of the construction of such profiles.

The invention will be further elucidated in the following description with reference to the annexed figures.

Figure 1:
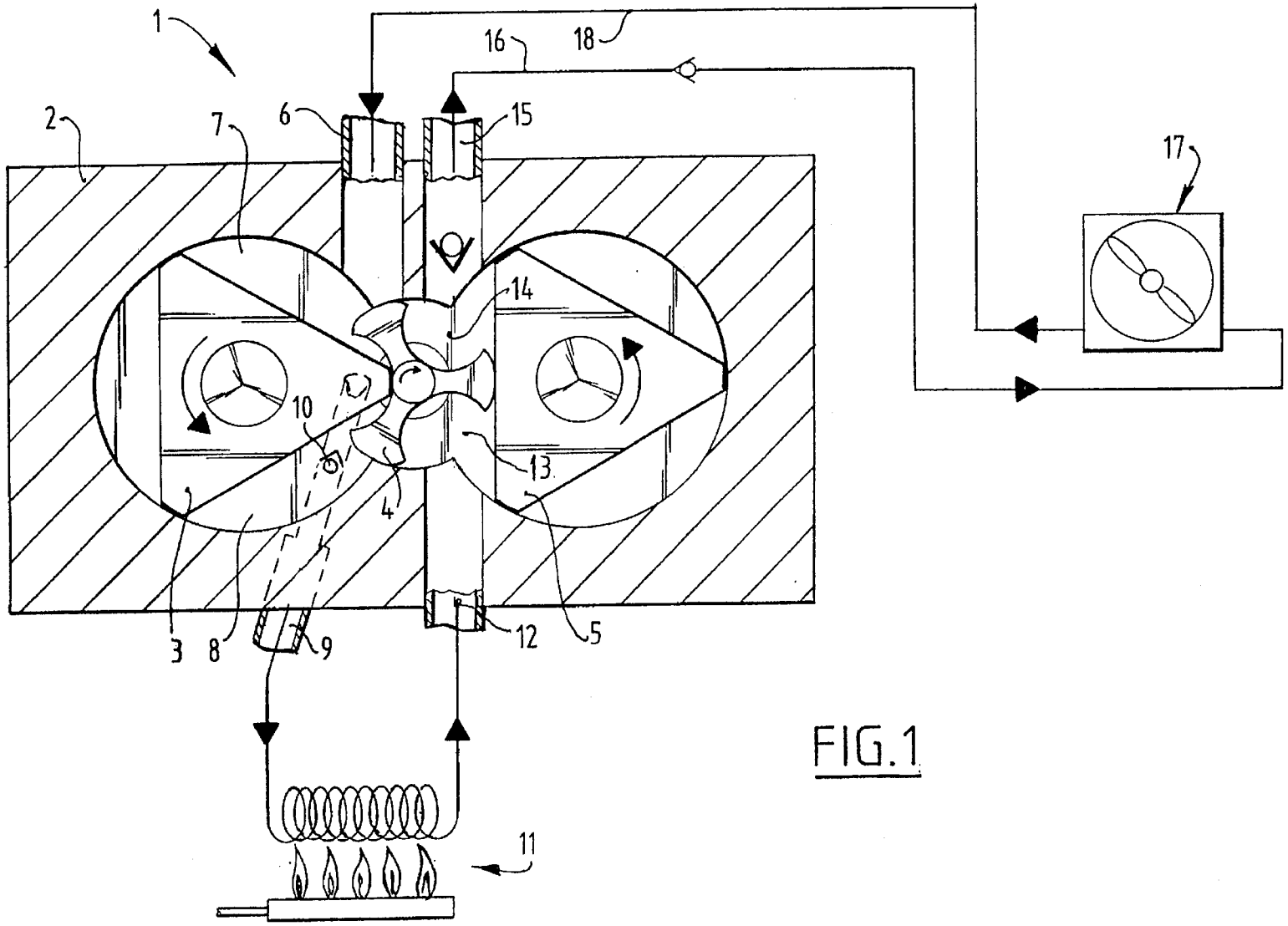
FIG. 1 shows schematically a hot gas motor according to the invention.

The hot gas motor 1 shown in FIG. 1 comprises a housing 2 in which three mutually overlapping cylindrical bores are formed. In the central, smaller bore a female rotor 4 is rotatably mounted and in the two other bores male rotors 3 and 5 respectively are likewise rotatably mounted.

Rotors 3–5 are coupled such that they rotate at equal rotation speed in the direction indicated with the arrows. The female rotor 4 therefore rotates in a direction opposed to that of the male rotors.

The rotors have a profile such that except for a very small gap they are in mutual contact in any rotational position. A displacement system is hereby formed. This is generally known per se, as for instance from the European patent specification 0 211 826.

Figure 4:
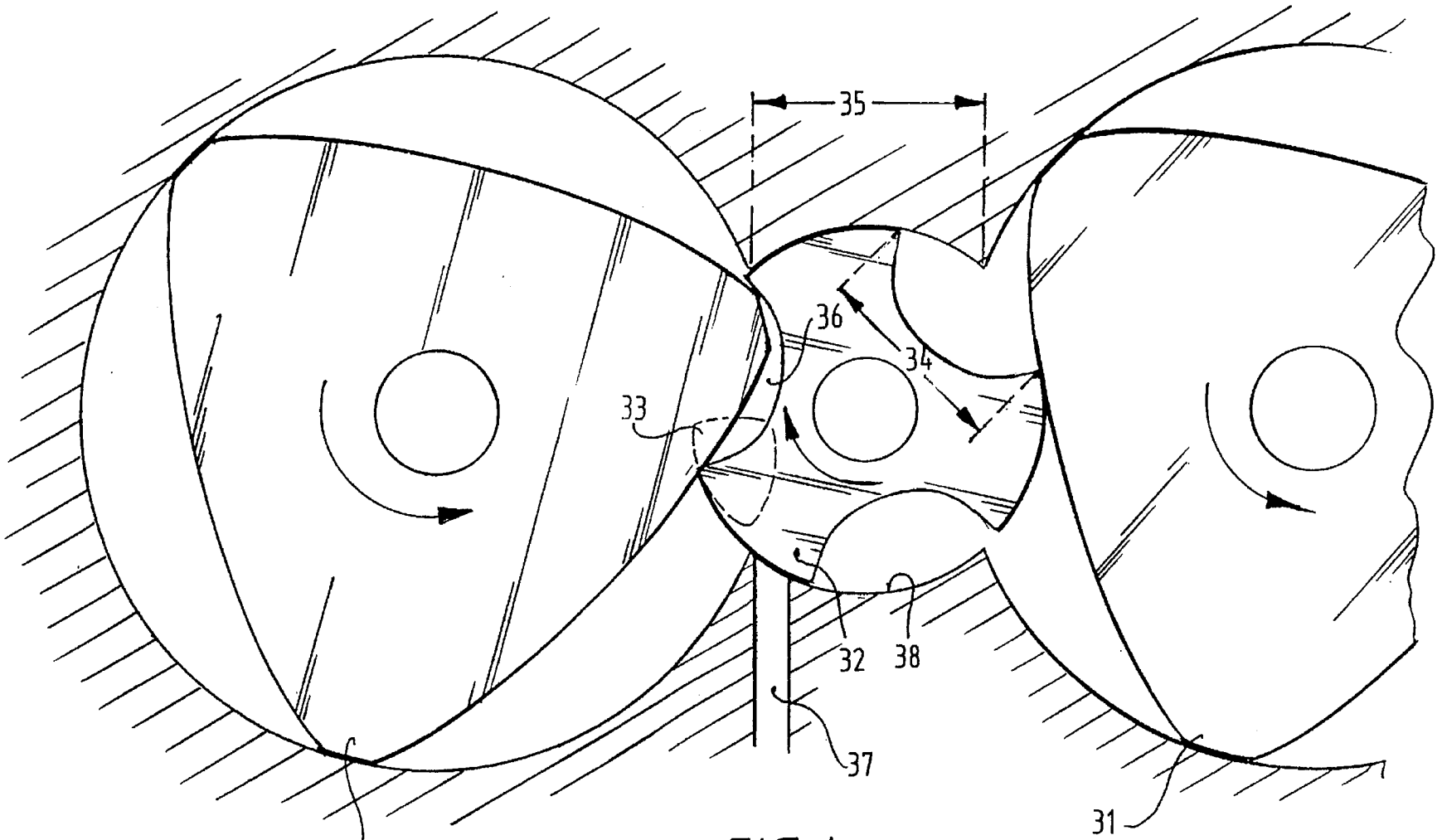
FIG. 4 shows schematically the cross section of a preferred embodiment of rotors for a motor according to the invention.

Since the actual form of the profile of the rotors does not form part of the present invention, these are not reproduced precisely in the figures. Only FIG. 4 gives a schematic example of rotor profiles which could actually be applied.

The compressor stage has an inlet 6 through which gas can flow to the chamber 7. Due to the rotation of rotor 3 this gas is carried along counter-clockwise into the chamber position designated with 8. Due to the co-action of the rotors 3 and 4 the gas present in chamber 8 is subsequently compressed and discharged via the outlet conduit 9. A non-return valve 10 is arranged in this conduit. With an embodiment of the rotors as will be further elucidated below with reference to FIG. 4, a high compression factor can be obtained.

The highly compressed gas is heated in a schematically designated heat exchanger 11 whereby the volume of the compressed quantity of gas increases. The thus heated gas is guided via inlet conduit 12 to the high pressure side 13 of the expander stage. The rotor 5 is urged by this high pressure in the direction indicated with the arrow, wherein the gas is transported to the outlet chamber 14 of the expander. A lower pressure prevails in the expander chamber 14 since this is connected to the inlet 6 of the compressor. The outlet 15 of the expander is connected via a conduit 16 to a cooler 17 which further cools the gas already cooled by the expansion. The outlet of cooler 17 is connected via conduit 18 to the inlet 6 of the compressor.

A non-return valve can likewise be accommodated in the outlet of the expander.

Although not shown, a controlled valve can be accommodated in the inlet conduit 12 of the expander in order to obtain a dosage of the quantity of gas fed to the expander. A suitable gas for use in a hot gas motor as in FIG. 1 is for instance freon.

Figure 2:
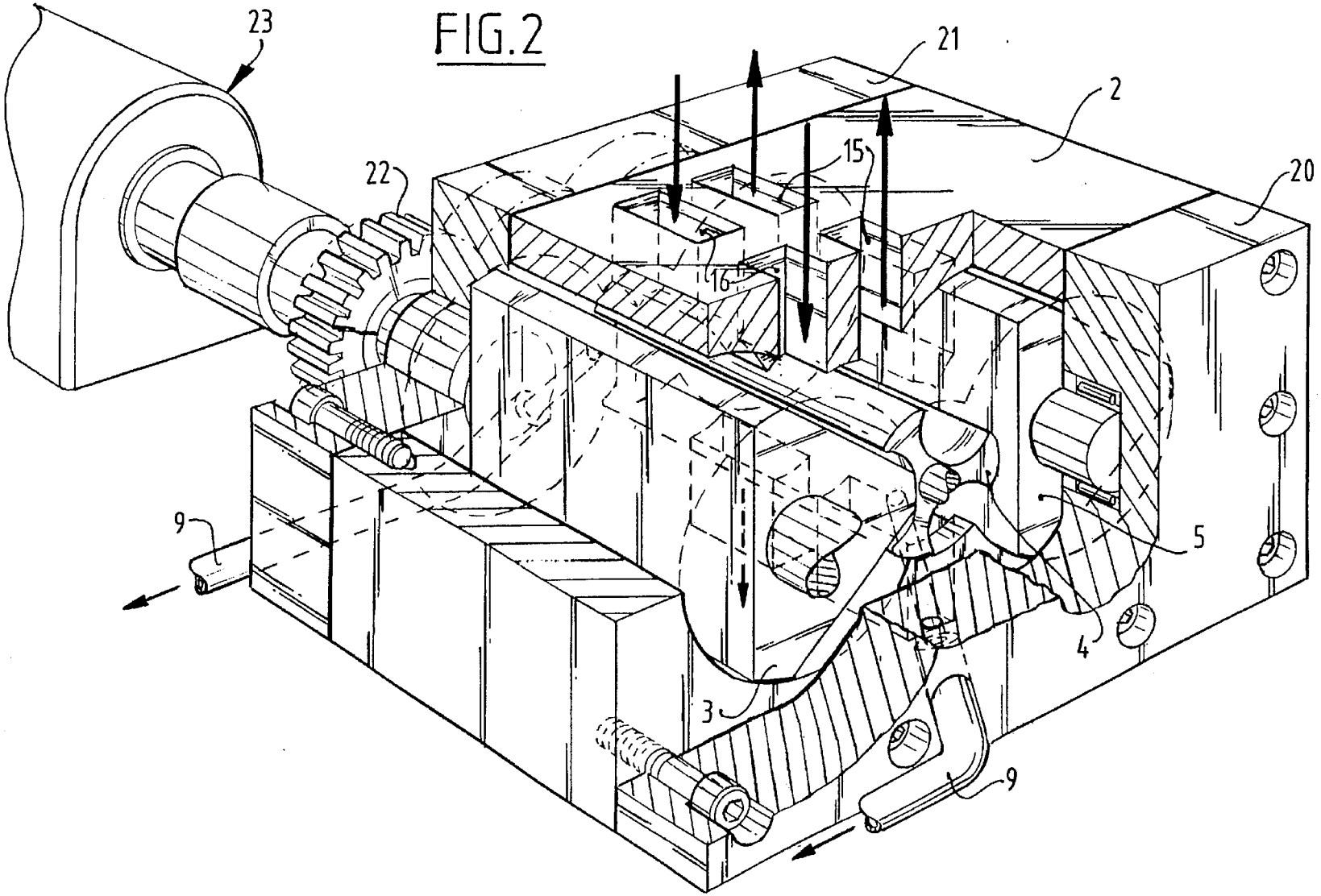
FIG. 2 shows the hot gas motor of FIG. 1 in partly broken away perspective view.

FIG. 2 shows a partly schematic perspective view with broken away parts of the device 1. Housing 2 has a block shape and is closed at both ends with covers 20, 21 in which the rotors 3–5 are mounted. Mounted on the ends of the rotors 3–5 protruding outside cover 21 are tooth wheels 22 which are in mutual engagement. Tooth wheels 22 all have the same number of teeth, whereby the described desired rotation ratio is achieved.

A generator 23 can for instance be coupled to motor 1 to generate electricity. The heating device is not shown in detail in FIG. 2 but may comprise a random burner, so that an easily available fuel can be used to drive the generator.

Figure 3:
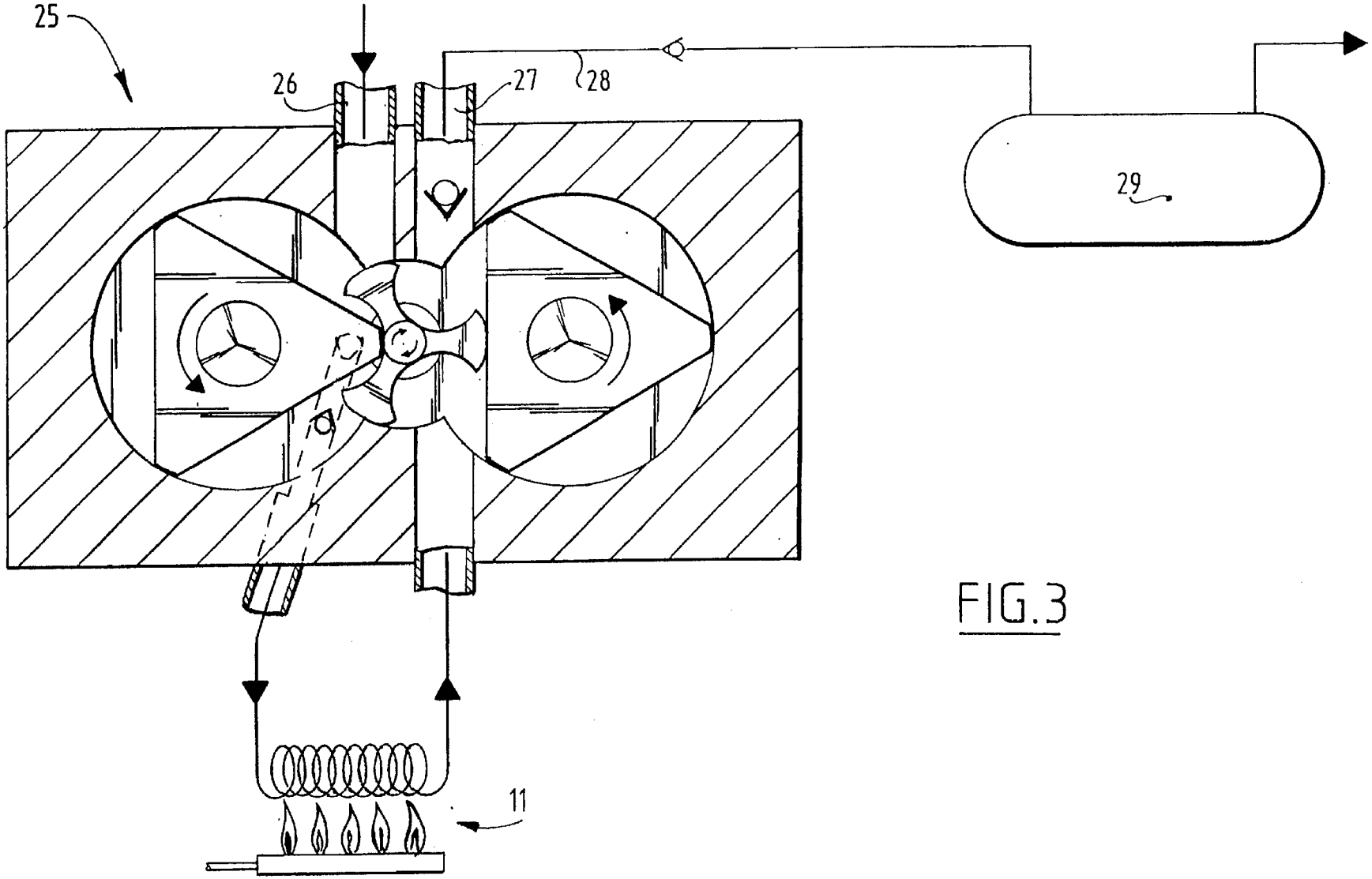
FIG. 3 shows a view corresponding with FIG. 1 of a motor/compressor unit according to the invention.

In the device 25 shown in FIG. 3 no closed gas flow is present but air is drawn in at the inlet 26 of the compressor stage which is released under increased pressure at the outlet 27 and is carried via conduit 28 to a compressed air reservoir 29. The air drawn into inlet 26 is greatly compressed in the compressor stage in the manner described with reference to FIG. 1, subsequently heated in the heat exchanger and partially expands again in the expander, whereby the required drive energy is released. The expansion takes place to the desired pressure for the compressed air.

In the embodiment as hot gas motor of FIG. 1 as well as in the embodiment as hot gas motor/compressor unit of FIG. 3, control can take place in suitable manner on the basis of the rotation speed. The control device will be embodied such that when the rotation speed decreases the heat supply is increased and vice versa. A substantially constant rotation speed can hereby be sustained.

The construction of the profile of the rotors lies within the reach of the skilled person. FIG. 4 shows profiles which are generally very suitable for the invention. The male rotors 30 and 31 co-act with an oppositely rotating female rotor 32. As shown, each of the male rotors 30, 31 and the female rotor 32 are profiled such that, in the positions in which a protruding part of a male rotor co-acts with a recessed part of a female rotor, these rotors are in mutual contact along two lines. Hereby formed between the male rotor and the female rotor is a chamber 36 which decreases to a very small volume. The transported gas can hereby be compressed to a high pressure and discharged with this high pressure via the delivery port 30 shown with dashed lines.

The width of the groove 34 in the female rotor 32 is smaller than the width 35 of the bridge, i.e. the remaining part of the cylindrical bore for the female rotor 32. This prevents a short circuit occurring between the compressor inlet and the expander outlet.

At each work stroke corresponding with one-third of a revolution of the rotor assembly, a quantity of heated gas under high pressure will be carried via the "lower" recess of the female rotor in the direction toward the compressor stage. This air under high pressure is preferably discharged via a conduit 37, the entrance to which is only left clear when the lower groove in the female rotor 32 is wholly in contact with the lower bridge 38, so that no undesired leakage from the first expander chamber to the discharge 37 can occur. Conduit 37 is connected to the low pressure side of the system via a conduit in which is accommodated a controlled valve. Preferably also accommodated in this conduit 37 is a heat exchanger through the other side of which flows the gas compressed under high pressure from the outlet of the compressor.

The invention is not limited to an embodiment with two male rotors and a female rotor. As shown in the device 40 of FIG. 5, three male rotors 41, 42, 43 can also co-act with a female rotor 44. Equal rotation speeds are applied forcibly in the directions indicated with arrows by a suitable toothed gearing 45. The additional third stage can be embodied as additional compression or additional expansion stage. The extra stage can thus be arranged in a position corresponding with the "underside" of the female rotor 32 in FIG. 4 in order to cause the gas under high pressure transported via the groove in this female rotor to expand in this extra stage so that the efficiency of the device is increased.

Figure 5:
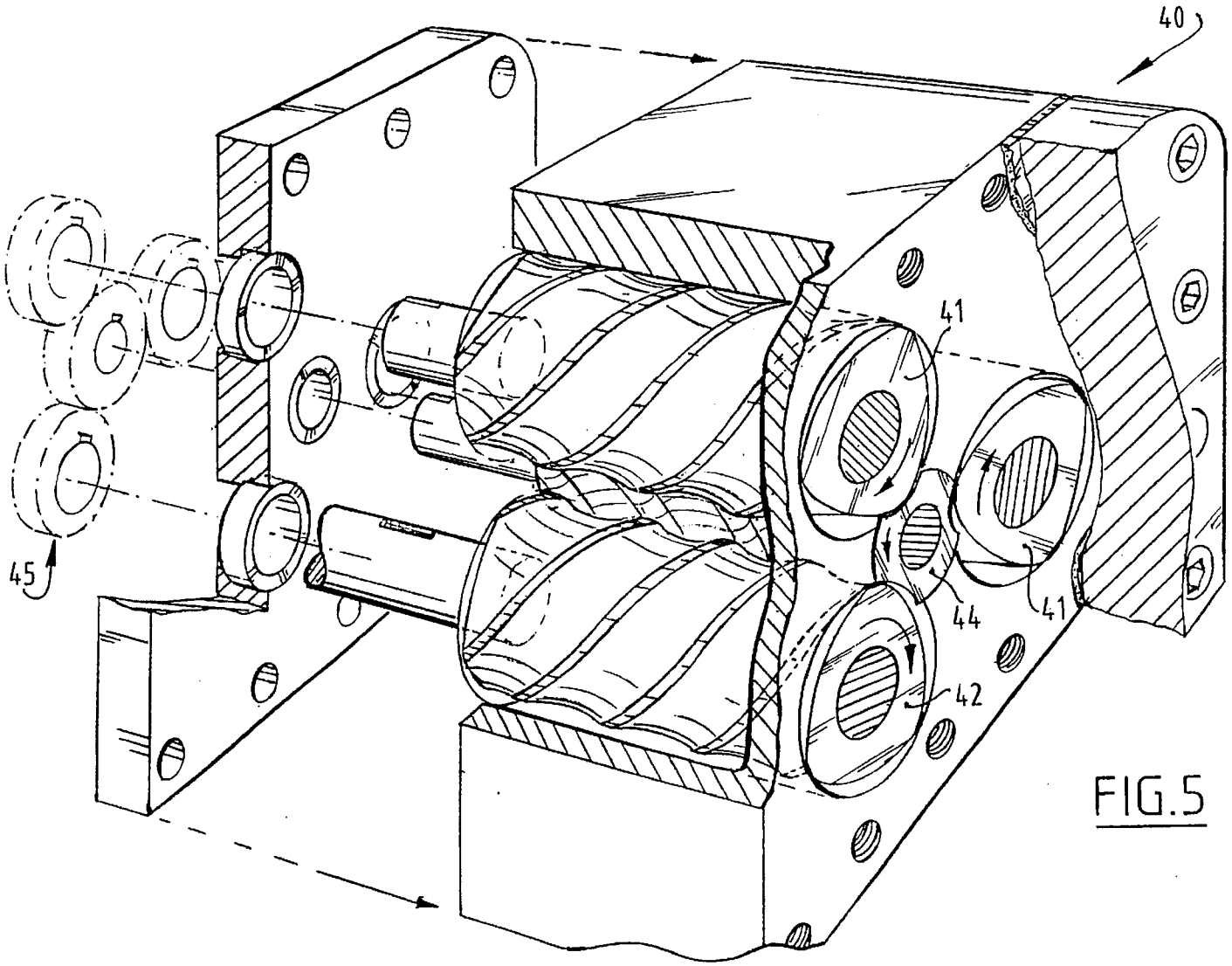
FIG. 5 shows another embodiment in partly broken away and simplified perspective view.

The profile of the rotors can be straight, as shown in FIG. 2, or helical as shown in FIG. 5. As noted above, these embodiments are per se known.

Although in the figures embodiments are shown in each case wherein the female rotor has the same rotation speed as the male rotors, this is not essential for the invention. The female rotor can have a larger number of recesses than the male rotors have protrusions in order to obtain a construction which is optimal for the intended application and the available space. Nor does the diameter of the female rotor have to be smaller than that of the male rotors. Particularly in the case of devices with more than two male rotors, such as the device 40 of FIG. 5, it will be appropriate for the female rotor to have a larger diameter.

All such embodiments are deemed to fall within the scope of the following claims.

I claim:

1. Hot gas motor comprising a compressor with an inlet and an outlet, an expander with an inlet and an outlet, wherein the compressor outlet and the expander inlet are mutually connected by a connecting channel comprising a gas heating device, wherein the compressor is of the rotation type with at least one male rotor mounted in a first cylindrical chamber in a housing and having a profile with protruding parts, which engages in a female rotor which has a profile with recesses co-acting therewith and which is mounted in a second cylindrical chamber intersecting the first cylindrical chamber and wherein the expander is formed by the female rotor and at least one male rotor having a profile with protruding parts co-acting therewith, and wherein the rotors are mutually coupled for rotation.

2. Motor as claimed in claim 1, wherein all male rotors are identical.

3. Motor as claimed in claim 1, wherein the compressor inlet is connected to the environment in order to draw in ambient air and the expander outlet is connected to a compressed air pressure reservoir.

4. Motor as claimed in claim 1, wherein the expander outlet and the compressor inlet are mutually connected by a connecting channel comprising a gas cooling device.

5. Motor as claimed in claim 1, wherein the compressor rotors are profiled such that they are in mutual contact along two lines at least close to the position corresponding with the end of a compression stroke and that the compressor outlet comprises an outlet port in a wall of the housing against which lies a head end surface of the female rotor, which outlet port extends in a region which is traversed by both the female and male compressor rotor.

6. Motor as claimed in claim 1, wherein a non-return valve allowing a flow from the compressor outlet to the expander inlet is accommodated in the connecting channel containing the gas heating device.

7. Motor as claimed in claim 1, wherein the protruding parts of the male rotors have a cylindrical end surface co-acting with the wall of the cylindrical chamber.

8. Motor as claimed in claim 1, wherein the number of protruding parts of the male rotor or rotors is equal to the number of recesses of the female rotor so that during operation these rotate with the same rotation speed.

9. Motor as claimed in claim 1, wherein the heating device comprises a burner.

10. Motor as claimed in claim 1, comprising a control device which adjusts the heat production of the heating device in accordance with an intended motor rotation speed.

* * * * *